United States Patent [19]

West

[11] Patent Number: 4,683,836

[45] Date of Patent: Aug. 4, 1987

[54] AIRBRUSH GUIDANCE SYSTEM

[76] Inventor: Peter West, Box 386, Claysville, Pa. 15323

[21] Appl. No.: 816,726

[22] Filed: Jan. 7, 1986

Related U.S. Application Data

[63] Continuation-in-part of Ser. No. 727,752, Apr. 26, 1985, abandoned.

[51] Int. Cl.[4] ..... B05B 15/06; B05B 15/08

[52] U.S. Cl. ..... 118/305; 118/323; 33/26; 33/27.04; 33/27.07

[58] Field of Search ..... 269/71, 289, 290; 248/441.1, 448, 161; 118/305, 323; 401/193; 33/26, 27.04, 27.07

[56] References Cited

U.S. PATENT DOCUMENTS

| | | | |
|---|---|---|---|
| 951,255 | 3/1910 | McMurray . | |
| 2,212,576 | 8/1940 | Teodonno | 118/323 |
| 2,286,664 | 6/1942 | Anderson | 33/27 |
| 2,312,154 | 2/1943 | Fischer | 33/26 |
| 2,741,222 | 4/1956 | Shelton | 118/323 |
| 2,781,582 | 2/1957 | Worsch | 33/27 |
| 3,067,517 | 12/1962 | Matson | 33/26 |
| 3,139,471 | 6/1964 | Root | 266/23 |
| 3,226,829 | 1/1966 | Graham | 33/18 |
| 3,378,927 | 4/1968 | Lowery | 33/26 |

FOREIGN PATENT DOCUMENTS

| | | | |
|---|---|---|---|
| 7606496 | 12/1977 | Netherlands | 427/323 |
| 1555959 | 11/1979 | United Kingdom . | |

*Primary Examiner*—Shrive P. Beck

*Attorney, Agent, or Firm*—Carothers & Carothers

[57] ABSTRACT

A novel and improved airbrush support and guidance apparatus which permits an airbrush to be held at a uniform standoff distance and at a preselected orientation with respect to a workpiece surface while traversing the workpiece surface in a preselected path of travel including freehand or generally curvilinear paths of travel, as well as, linear, and circular arc paths of travel, while maintaining a uniform standoff and orientation respect to the workpiece surface to provide for increased precision in the rendering of airbrush artwork.

11 Claims, 10 Drawing Figures

AIRBRUSH GUIDANCE SYSTEM

This is a continuation-in-part of copending application Ser. No. 727,752 filed Apr. 26, 1985, now abandoned.

BACKGROUND OF THE INVENTION

In the graphic arts the airbrush has long been used to produce effects which cannot be readily attained by any other means. The airbrush employs a venturi effect to aspirate paint or other liquid coloring medium into an airstream which is then directed at a work-piece such as a canvas or other usually flat surface.

The effect achieved by airbrush techniques depends upon many factors including but not limited to the pattern formed by the airstream as it emanates from the airbrush nozzle, and the standoff or separation distance between the nozzle and the workpiece. Typically, the airbrush nozzle is continuously adjustable to produce a wide range of spray patterns from a finely "focused" line to a broad fan pattern. Both the nozzle adjustment and the standoff distance affect the result, which may vary from a relatively fine line to an open pattern of tone or color, to broad ranges of color intensity variation over either wide or narrow color fields.

More specifically, the airbrush is basically a spray painting devide that can be regulated to spray fine lines to broad tonal spray patterns by atomizing a mix of air and pigment to produce an airborne mist or spray. As the atomized pigment is propelled from the airbrush, the spray develops into a circular spray pattern to produce line work which may be regulated from fine pencil like lines, to broad modulated tones or sprays patterns. A basic characteristic of all airbrushed spray patterns is a soft appearance, even when regulated to fine line settings. When the airbrush is regulated to a fine spray setting, it must be positioned close to the painting surface and when regulated to a heavy setting, it must be positioned further from the surface. The standoff distances (spacing between workpiece surface and airbrush nozzle) range from approximately $\frac{1}{8}''$ to 8" or more. As a result of this operational characteristic, the airbrush must be used in continuously spaced orientation from the painting surface at various selected standoff distances while in operation.

In order to produce forms or shapes with an airbrush, a variety of stencil techniques have commonly been used to confine the spray to specific areas, thus creating a hard edge on the contour of the form.

Airbrushing straight spray patterns may currently be produced with the aid of a raised ruler. This, however, is only possible at very fine spray settings (when the brush is placed close to painting surface). The possibility of using a ruler is eliminated once the spray setting is charged from the finest settings as this requires moving the airbrush further away from surface. Once the spray setting has been even moderately changed, the distance required between airbrush and surface for proper operation eliminates not only the possibility of using a ruler but also use of all current mechanical drafting devices, which are operative only with the drawing tool directly in contact with the drawing surface.

Airbrushing heavier spray patterns with mechanical precision (which requires substantial distancing of the airbrush from surface) without the aid of a ruler, mechanical template device or stencil, is as difficult as producing a mechanical drawing without drafting equipment.

Other factors which influence the airbrush effect include the angle of incidence of the airstream from the airbrush nozzle with respect to the workpiece surface, and perhaps most importantly the feel or touch of the airbrush artist. In this regard, the skill of the airbrush artist ultimately determines the quality of the results, just as any other tool can produce fine work or mediocrity depending upon the skill of the user.

Because of its innate versatility, the airbrush in the hands of a highly skilled artist can produce an amazing variety of artistic effects ranging from the purely abstract to pictorial renderings so detailed that they are virtually indistinguishable from photographs. From the above, both the versatility of the airbrush and one of its attendant shortcomings are apparent, namely that the range of effects the tool can produce far exceed the skill of many good artists to produce them. The teaching of airbrush technique has heretofore relied almost exclusively on the artist's innate ability to comprehend and exercise the particular mode of airbrush use which best suits him. A simple mechanical assistance device which is hand manipulated by the artist in much the same manner as though he were performing freehand airbrush work could be of considerable benefit to help the novice airbrush artist gain an appreciation of the feel of airbrush technique, although to the knowledge of this applicant, no such device has been heretofore known.

For example, U.S. Pat. Nos. 3,067,517 and 3,226,829 relate generally to drafting machines with mechanisms for producing X-Y coordinate line work; the latter of these two patents, in particular does refer to airbrush work but is a highly complex mechanism and, unlike the present invention, is not at all well adapted to permit the airbrush artist the freedom required for truly creative airbrush art.

U.S. Pat. Nos. 3,378,927 and 951,255 relate to circle drawing devices for use in conjunction with a rigid-surface drawing medium (e.g., a chalkboard as in U.S. Pat. No. 3,378,927), but are unrelated to airbrush techniques.

U.S. Pat. Nos. 2,781,582; 2,286,664 and 3,139,471 disclose various center arrangements for producing circular motion of an instrument with respect to a workpiece. These too are unrelated to airbrush techniques.

Another shortcoming of the airbrush is that the traditional modes of freehand airbrush work virtually eliminate any possibility of gaining the precision of mechanical drawings in airbrush work. Of course, this limitation has in part defined the uses to which the airbrush might be put. Thus the art has not contemplated any means of using the airbrush for precision mechanical drafting and has ignored the possibilities for new and different modes of airbrush expression which might result.

Another limitation of known airbrush technique is that the dimensional limitations on work size or proportion have been related directly to the physical limitations of the artist's body. This occurs because the artist can experience the learned feel or touch of his individual airbrush technique only in certain limited body postures. As a specific example, the physical limitations of the artist's arm extension and movement will limit the radius of arcs and curves that he can accurately render with the airbrush. This can be a severe limitation in such large scale work as stage set design and production which often requires renderings on large panels that cannot be conveniently supported in a position suitable to allow the artist complete freedom of position and movement.

BRIEF SUMMARY OF THE INVENTION

The present invention comtemplates a novel airbrush support and guidance apparatus which operates as a mechanical drafting system exclusively for airbrush work and thereby alleviates the above and other shortcomings of the prior art. In one presently preferred embodiment, the invention comprises an adjustable frame with clamps by which the frame is secured to a conventional drafting table. A workpiece of very large or relatively small proportions may be secured to the frame and an airbrush support structure also is secured to the frame to thereby position and guide the airbrush with respect to the workpiece surface. The apparatus thus accommodates the specialized considerations pertaining to mechanically guiding-directing an airbrush, which existing equipment only provides for contact drawing instruments such as pens, pencils, rapidograph or ruling pen.

The airbrush supporting and guiding structure of this invention also contemplates a system which may be secured or supported directly on a conventional drawing board or drafting table on which the workpiece is carried, or to the workpiece itself if the workpiece is structurally rigid or includes a rigid frame such as a canvas on a stretcher frame.

The novel airbrush supporting and guiding structure of this invention further includes adjustable structural elements which guide the airbrush in precise straight line or circular arc paths to produce precise and uniform arcs and lines. The supporting and guiding structure also is adjustable to guide the airbrush for freehand work at a uniform (or uniformly varying) standoff or separation from the workpiece surface.

Thus, the airbrush guidance system will provide the airbrush with new capabilities which cannot currently be produced in any practical way.

Accommodation of the airbrush air hose and paint jar or cup are additional factors not accounted for by existing equipment. These factors, which would further prohibit use of an airbrush in conjunction with known drafting equipment, are also accommodated by the airbrush guidance system.

It is therefore one primary object of the invention to provide a novel and improved airbrush support and guidance apparatus.

Another object of the invention is to provide an apparatus for supporting and guiding an airbrush at a uniform, adjustable standoff distance from the workpiece surface.

Another object of the invention is to provide a novel airbrush support apparatus which permits large scale workpieces to be supported with respect to a conventional drafting table or other conventional base for precise airbrush work thereon.

A more specific object of the invention is to provide a selectively adjustable airbrush guidance apparatus which permits the artist to guide the airbrush in freehand, or in precise straightline or circular arc paths.

These and other objects and further advantages of the invention will be better understood upon consideration of the following detailed description and the accompanying drawings, in which.

Figure 1:
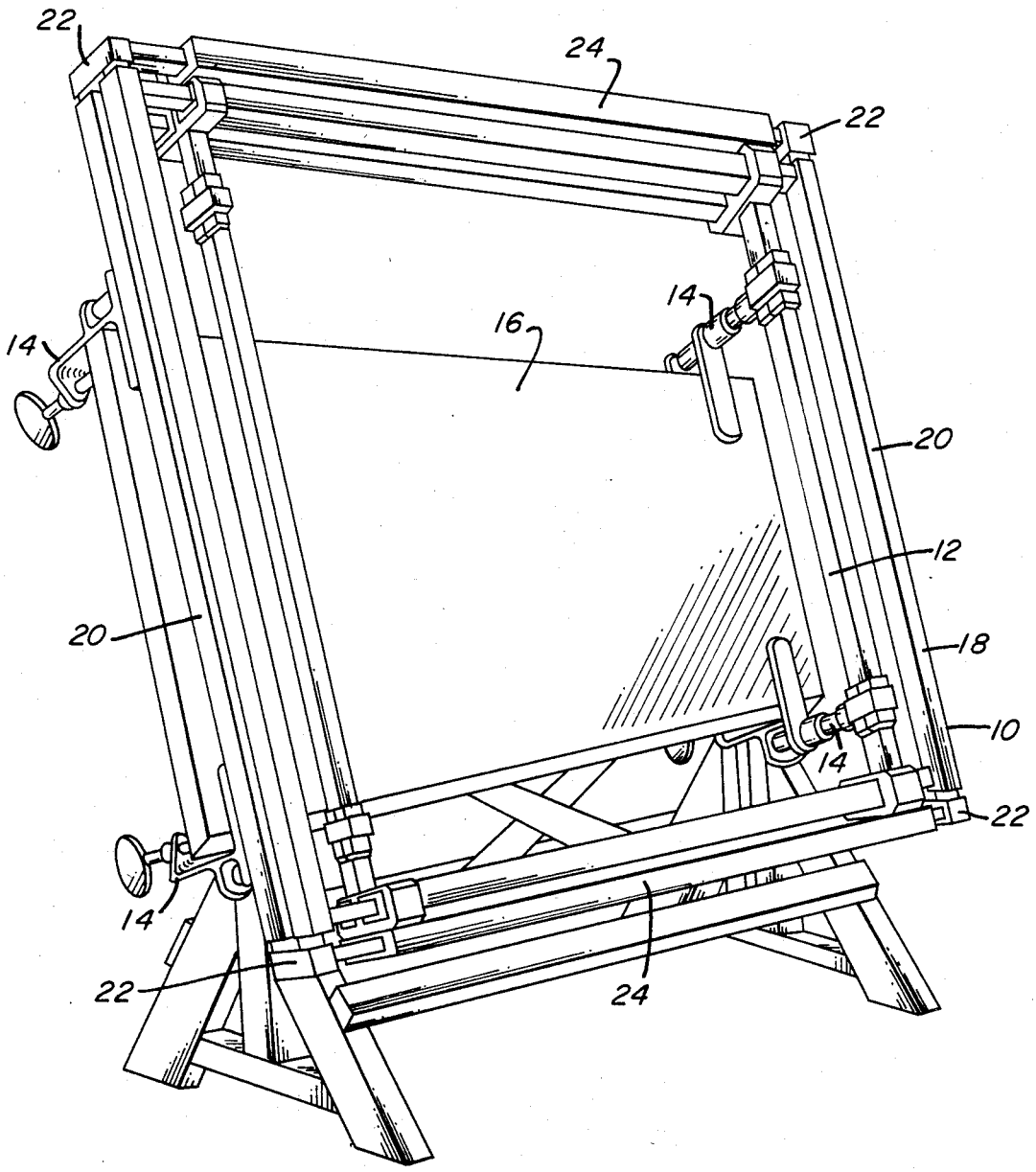
FIG. 1 is a perspective view of the adjustable work holding frame of this invention secured to a conventional drafting table.

There is generally indicated at 10 in FIG. 1 a selectively adjustable frame assembly which forms a part of the airbrush guidance apparatus of the present invention. Frame assembly 10 comprises a generally rectangular structural support frame 12 having a plurality of clamps 14 located adjacent the corners thereof and by which frame assembly 10 may be secured with respect to a base such as a conventional drafting table 16.

Figure 2:
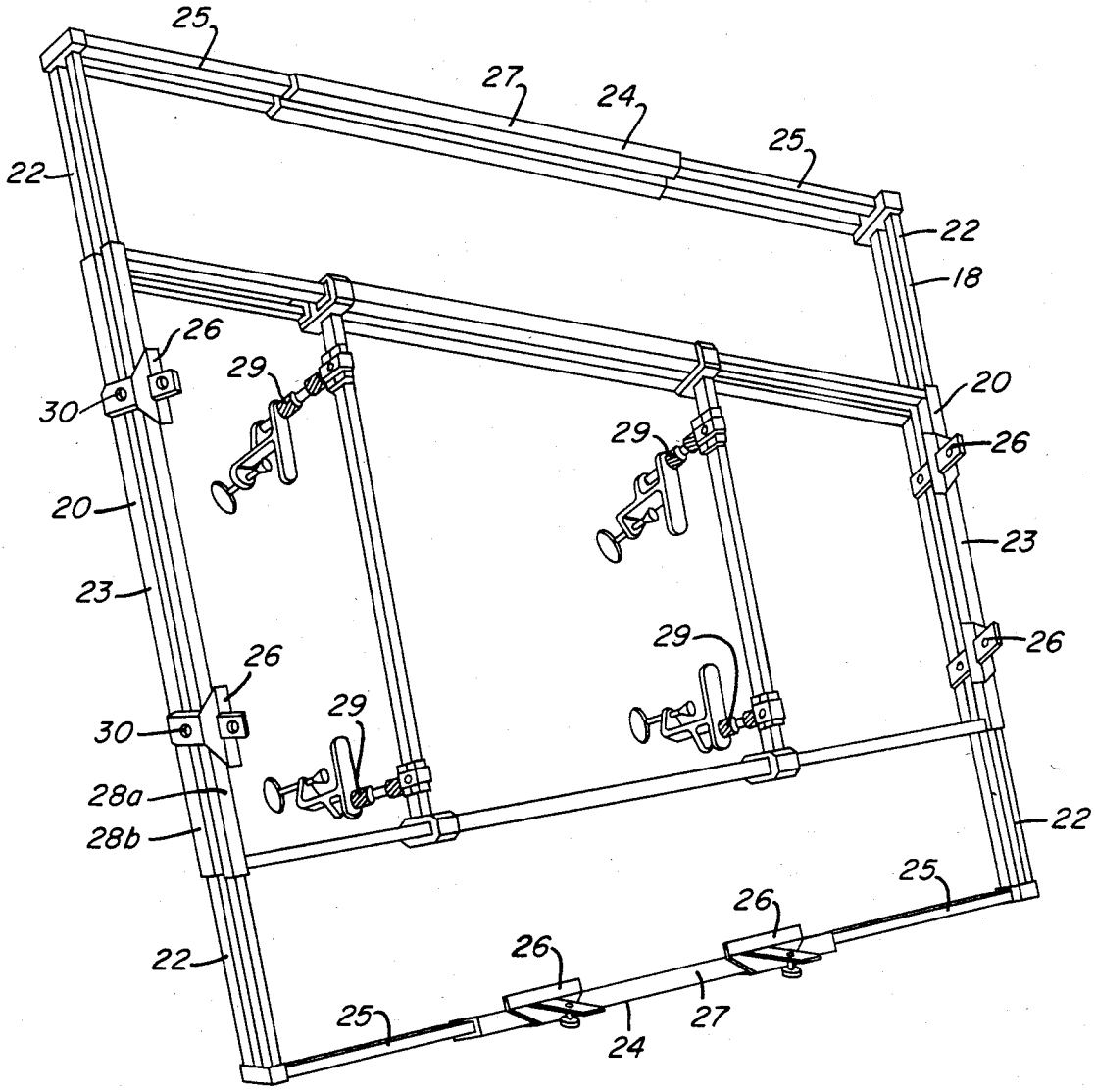
FIG. 2 is a perspective view of the work holding frame in an extended configuration.

An adjustable work holding portion 18 of frame assembly 10 is carried by structural support frame 12 and is selectively adjustable with respect thereto from relatively smaller to relatively larger sizes (as shown in FIG. 2) whereby frame 10 is adapted to provide perimeter support for a range of workpiece sizes including sizes far in excess of those drafting table 16 would usually accommodate.

Specifically, frame portion 18, as shown in FIGS. 1 and 2, comprises a pair of generally vertically extending, laterally spaced apart leg assemblies 20 having telescoping, slideably interfitted upper and lower ends 22 which are adjustable upward and downward, respectively, from a central leg portion 23 to accommodate a range of workpiece heights and vertical positions. A similarly adjustable pair of horizontally extending upper and lower leg assemblies 24 extend between and are suitable connected to the upper and lower leg end portions 22, respectively. Leg portions 24 also are adjustable by telescoping action of slideably interfitted sections 25 from a central portion 27 to accommodate a range of workpiece lengths. Accordingly, the entire frame portion 18 is adjustable from a fully collapsed configuration as shown in FIG. 1 to a much larger fully extended configuration as shown in FIG. 2.

Suitable clamps 26 (FIG. 2) are positioned on the perimeter of frame portion 18 preferably but not necessarily on central portion 23 and 27. This is to avoid any interference with the described telescoping action which might otherwise result if the clamps 26 were mounted on the slideably interfitted portions of the leg assemblies. Clamps 26 are operable to secure a workpiece with respect thereto within the perimeter of frame portion 18. It will be noted that each leg assembly of frame portion 18 preferably comprises a pair of parallel telescoping assemblies as at 28*a*, 28*b* in FIG. 2. Accordingly, clamps 26 and other attachments for frame portion 18 may be secured thereto by a fastener such as a screw and nut assembly 30 which is passed between assemblies 28*a* and 28*b* to engage opposite sides of the respective assemblies 28*a* and 28*b* and releasably secure the clamps 26 thereto. Other elements of the disclosed apparatus which are to be attached to frame portion 18 may be secured in a similar fashion.

Figure 3:
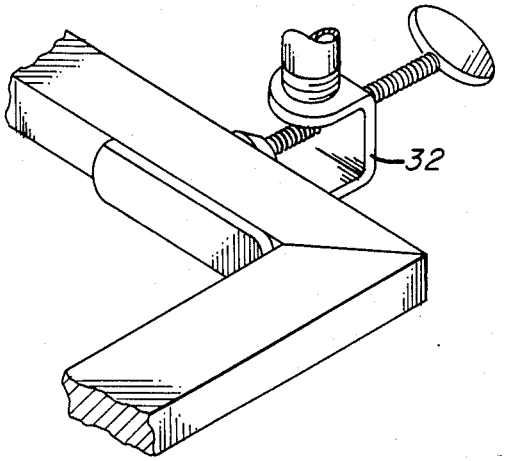
FIG. 3 is perspective view of an alternative clamp for securing the frame to a workpiece frame rather than to a drafting table.

Of course it is to be appreciated that frame assembly 10 may be secured to bases other than a drafting table. For example, frame 10 may, in one alternative embodiment, be secured directly to a workpiece such as a canvas on a stretcher frame by substitution of a screw clamp 32 (FIG. 3) for the clamp 14. In entirely similar fashion, the various arrangements of the airbrush guiding structure described hereinbelow may be alternatively secured to a drafting board or table, to the frame assembly 10, or directly to the workpiece, by selection of the appropriate clamp 14, 32, or other suitable clamp structure. To accommodate this versatility, clamps 32, 14, and others preferably are releasably secured with respect to the elements they support as by threaded fasteners, for example, free-turning internally threaded collars 29 may be employed at each clamp location to secure a variety of clamp structures.

Figure 4:
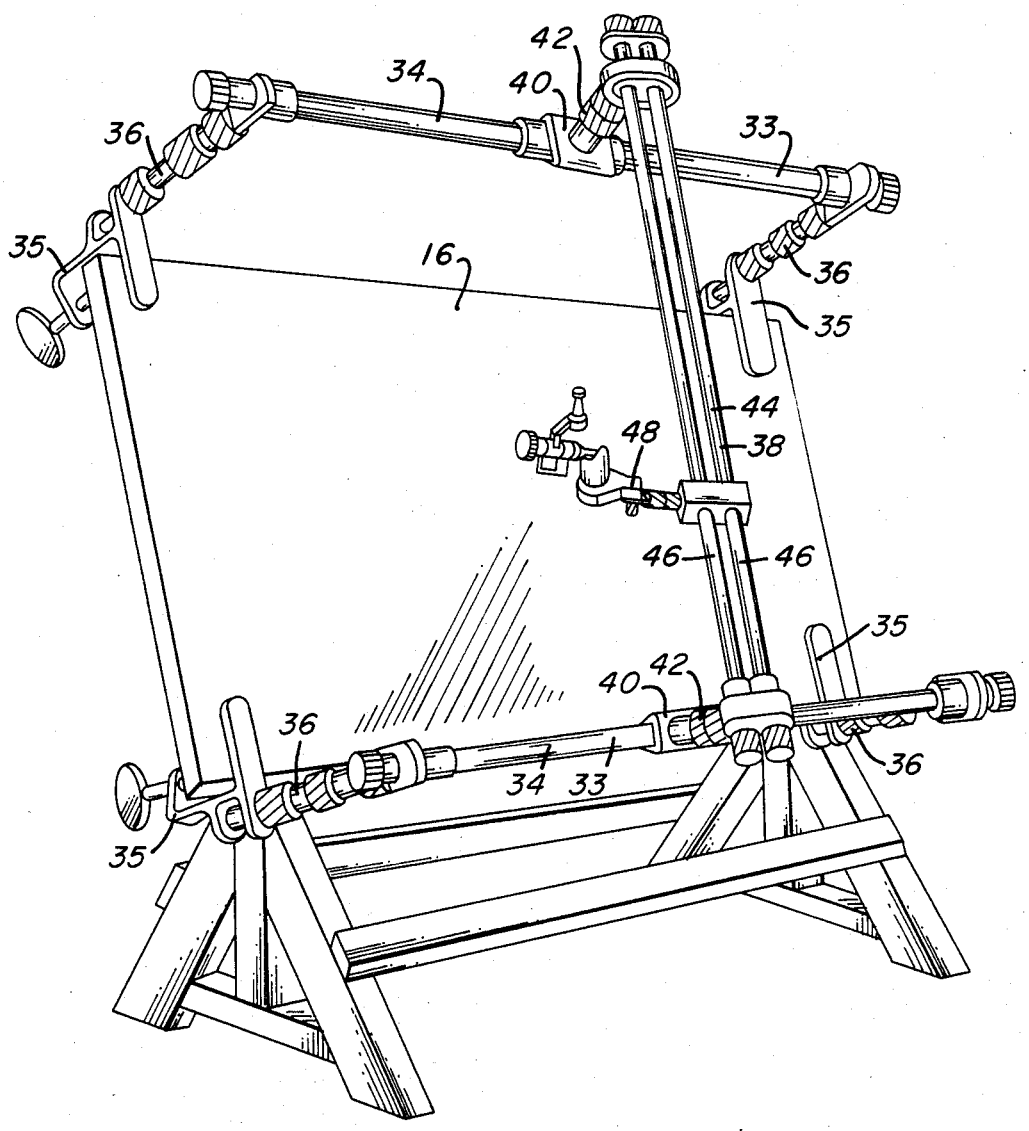
FIG. 4 is a perspective view of the airbrush support and guiding apparatus of this invention with attachments for producing straight line and freehand work, the apparatus being shown secured to a conventional drafting table.

In FIG. 4, the airbrush guiding and supporting structure is shown mounted on a drafting table, although as mentioned it may just as readily be mounted on the frame 10. The airbrush guiding and support structure preferably comprises a pair of vertically spaced apart assemblies 33, each comprising an elongated rod-like member 34 having telescoping adjustable length standoff legs 36 adjacent the opposite ends thereof. Clamps 35 which may be similar in all salient respects to clamps 14 or 32, are secured adjacent the free ends of standoff legs 36 to secure the members 34 with respect to the drafting table 16 or other suitable base. Of course, for the configuration shown, the workpiece is preferably carried directly on drafting table 16. Alternatively, assemblies 33 may be secured to the perimeter of frame portion 18 or to a workpiece frame, as above discussed, depending upon the particular clamp configuration selected, the requirements imposed by the size and weight of the workpiece, and the convenience of a given workpiece and airbrush guide support scheme for the particular artist.

An airbrush holding assembly 38 extends between members 34 and is slideable lengthwise thereof on sliding guides 40. Holding assembly 38 comprises adjustable length standoff legs 42, similar in all respects to legs 36, which project outwardly from sliding guides 40 and each of which has secured adjacent the outer end thereof one end of an airbrush guide structure 44 that is comprised of a pair of elongated rod-like members 46 which extend intermediate the legs 42.

An articulated airbrush holder assembly 48 is slideable lengthwise of members 46 whereby the airbrush guiding and support structure permits combined vertical and horizontal freehand motion of an airbrush carried thereby over the surface of a workpiece carried by table 16.

Figure 5:
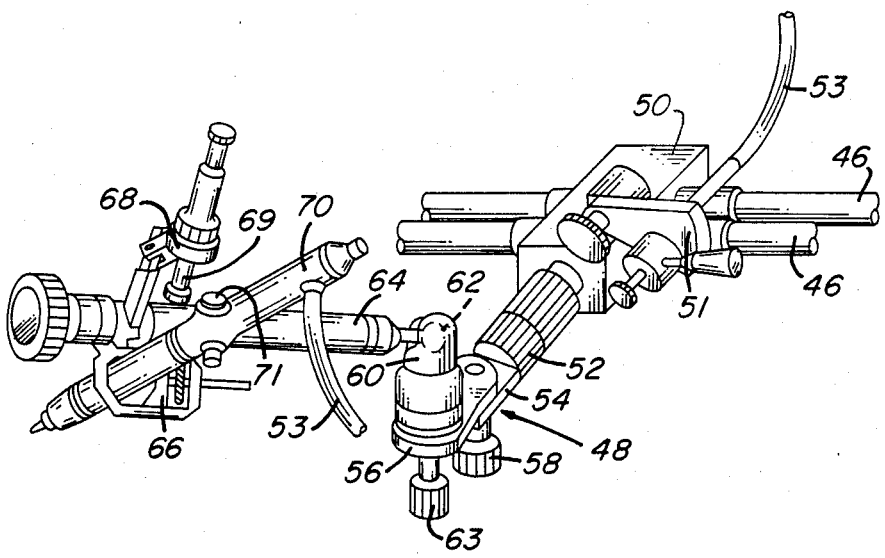
FIG. 5 is a fragmentary portion of FIG. 4.

As shown in FIG. 5, airbrush holder assembly 48 comprises a slideblock 50 that slides lengthwise of rods 48 and to which an airbrush carrier arm assembly 52 is adjustably secured. The carrier arm assembly 52 comprises a mounting stud portion 54 affixed to slideblock 50 and a ball and socket joint assembly 56 pivotally affixed as by a screw 58 to mounting stud portion 54. The ball and socket joint assembly 56 in turn comprises a socket portion 60 which receives a ball portion 62 for selective free pivotal movement therebetween, and a screw clamp 63 which is operable to selectively clamp the ball and socket joint in any of a variety of relative positions with respect to the workpiece. The ball and socket joint thus permits adjustment of the airbrush position with respect to stud portion 54 substantially throughout a hemispherical range of motion. An elongate airbrush carrier arm portion 64 is rigidly affixed to and extends outwardly from ball portion 62 and has adjacent the free end thereof an airbrush support bracket and clamp 66 and an airbrush actuator assembly 68. Slideblock 50 also carries a pushbutton cable release assembly 51 having a flexible cable 53 which in practice is connected to actuator assembly 68 to permit for one-hand actuation of the airbrush 70 and simultaneous guiding of the airbrush motion by manual, horizontal and vertical force applied to slideblock 50. Of course, in practice the actuator assembly 68 is positioned so that the actuating plunger 69 thereof, will engage and actuate the conventional actuator button 71 on the airbrush 70.

The above described structure affords a wide range of adjustability to the airbrush 70 supported thereby, including rotation of air 64 about is longitudinal axis, the adjustability of ball and socket joint 56, a short radius lateral swing of joint 56 with respect to mounting stud 54, and rotation of the entire assembly 52 about the longitudinal axis of stud 54. These various modes of adjustment, together with the combined vertical and horizontal freehand sliding motion as above described and the available adjustment of standoff distance afforded by telescoping standoff legs 36 and 42, permit the artist to maintain the airbrush at a completely uniform (or uniformly varying) but nontheless readily adjustable standoff distance and at an orientation and angle of incidence with respect to the workpiece, with a high degree of control over other factors relating to the position of the airbrush in use. Thus, the artist is able to utilize the airbrush in freehand fashion over large expanses of surface with minimal fatigue and with high degree of uniformity, and in a position that best accommodates his particular technique.

All of the adjustment and selective securing features described heretofore may be provided by any of several well known mechanisms. All telescoping or otherwise adjustable length members, as shown in FIG. 4 for example, may incorporate telescoping tubular elements with screw clamp securing as in conventional collapsible tripods for cameras, or set screw securing arrangements as are well known. All pivotal or otherwise articulated elements may be securable by set screws or other known screw clamping structures. The further aspects of the invention described hereinbelow incorporate the same sorts of selective securing elements as appropriate, and for purposes of brevity these will not be described in detail.

Figure 6:
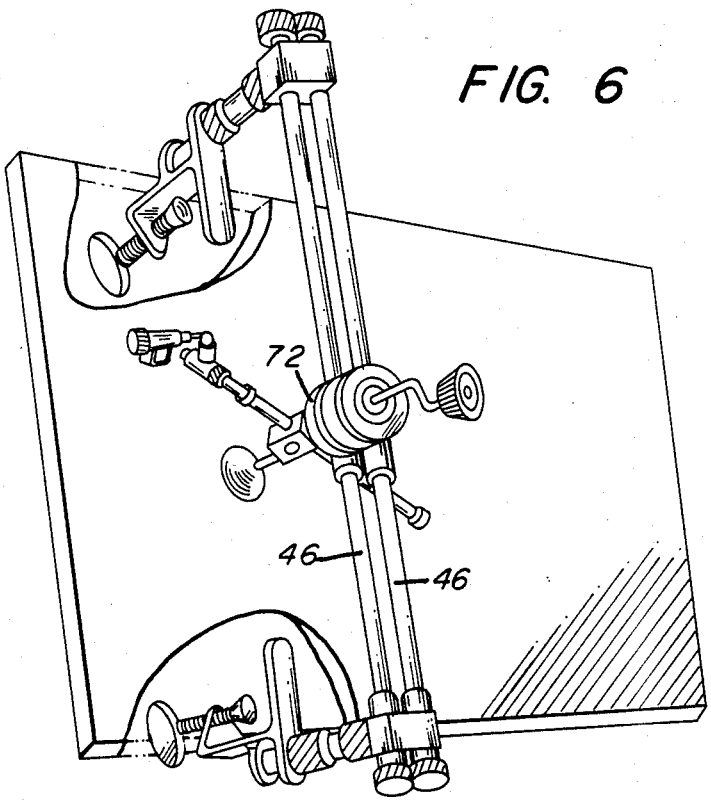
FIG. 6 is a perspective view of the airbrush support and guiding apparatus with attachments for producing circles and arcs.

It will be further appreciated that if it is desired to produce only precise straight line work rather than freehand work, the holding assembly 38 may be clamped directly to the drafting table, frame or workpiece as above described, in the manner shown in FIG. 6 for example. Alternatively, the arangement of FIG. 4 may be utilized with either the vertical or horizontal slide capability locked to permit only linear motion of the airbrush along a single predetermined line. Still further, with the apparatus locked to produce such rectilinear motion, the airbrush holder assembly 48 may be adjusted to provide parallel line work along such line of motion.

FIG. 6 also illustrates use of the circle assembly 72 of the invention, which is used for circle and arcuate airbrush work. Circle assembly 72 is slideable on rod members 46 and may be selectively clamped in a fixed position thereon just as holder assembly 48 may be. Likewise, circle assembly 72 may be utilized in conjunction with the guide and support configuration of FIGS. 6 or 4, as well as with other above described configurations such as the support and guide structure being carried by the frame 10, for work on a workpiece supported on a drafting table or by the frame 10 itself.

Figure 7:
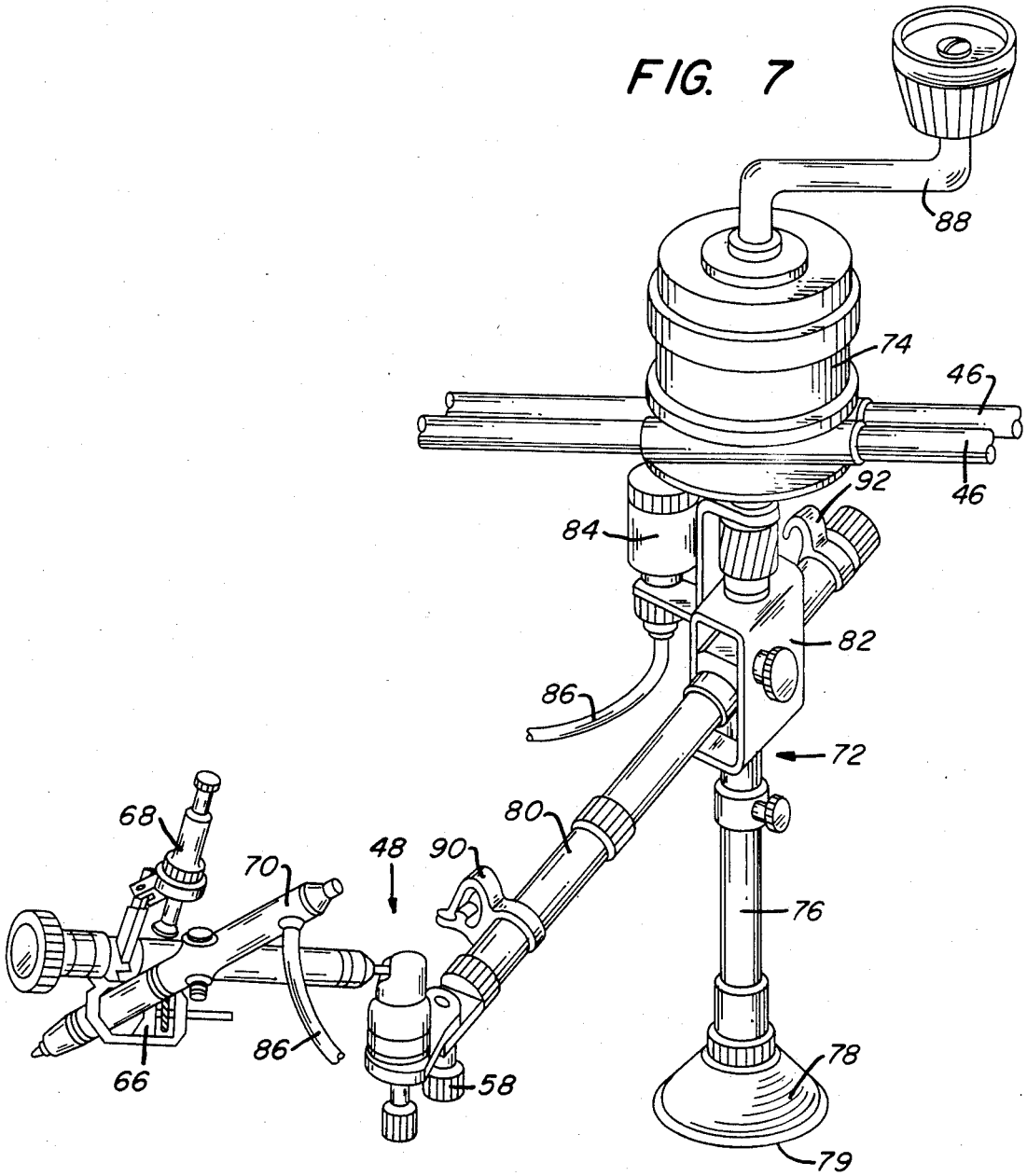
FIG. 7 is a fragmentary portion of FIG. 6.

As shown in FIG. 7, the circle assembly 72 incorporates a sliding pivot block 74 in place of slide block 50 of holder assembly 48, and an extendable support member 76 which extends therefrom to engage the workpiece surface and thereby stabilize circle assembly 72. An enlarged foot member 78 directly engages the workpiece surface over an enlarged surface area 79 to provide the desired stabilizing without damage to the workpiece surface. In the case of a thin section workpiece, the foot 78 may be a magnetic element which is magentically attached to a steel plate positioned adjacent the back surface of the workpiece to thereby securely sandwich the canvas therebetween. Other possible alternative structures for foot 78 may be a suction cup or a rubber pad.

The foot 78 and pivot block 74 both are rotatable with respect to member 76 whereby an airbrush holder arm 80 affixed to an arm retainer portion 82 of member 76 is pivotable about the axis of member 76. The airbrush holder assembly 48 is carried adjacent the outer end of arm 80 to provide the selective adjustments of airbrush 70 as above described. The holder assembly 48 of FIG. 7 is identical to that described hereinabove with reference to FIG. 5. Therefore, that description is not repeated here. Also included in the circle assembly 72 is the cable release actuator function substantially as described hereinabove and shown in FIG. 5, and a remore paint reservoir which provides for supply of paint from a paint cup 84 mounted adjacent arm retainer 82, via a delivery tube 86, to airbrush 70.

A hand crank 88 is affixed atop pivot block 74 and is connected therethrough to member 76 to permit improved ease of producing the desired circular or arcuate motions.

Of course, for each of the embodiments described herein, there must be accommodation for the pressurized air supply to the airbrush. Accordingly, the conventional air hose (not shown) which supplies air to the airbrush may be captured in retention clips 90, 92, as shown in FIG. 7 for example, or in entirely similar clip arrangement provided for the other described embodiments to retain the air supply hose in a desired position where it does not obstruct the work.

Figure 8:
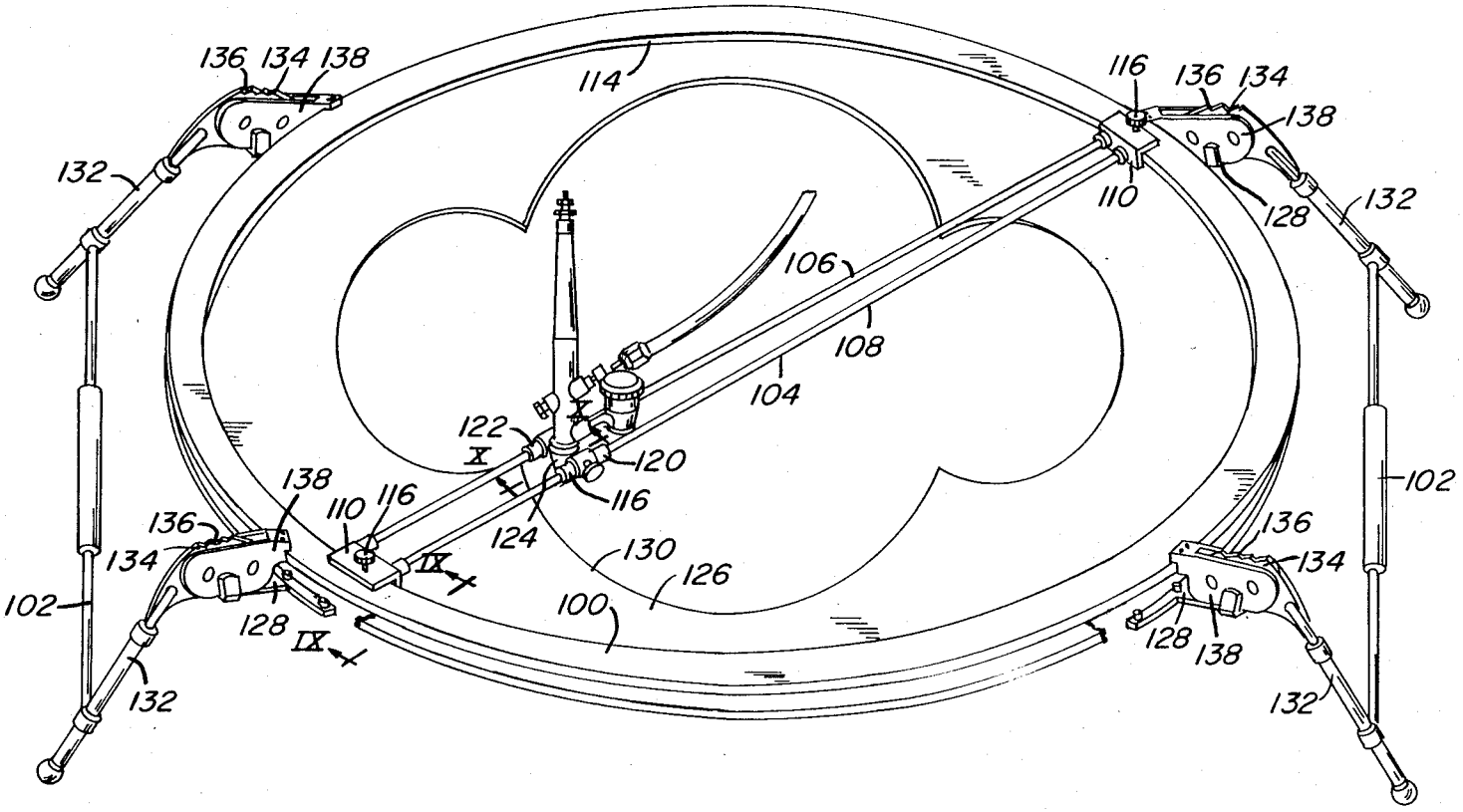
FIG. 8 is a perspective view of another preferred embodiment of the invention.
Figure 9:
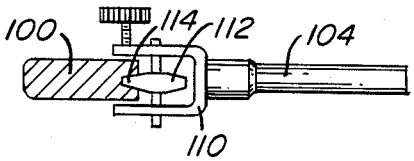
FIG. 9 is a fragmentary sectional view taken on lines IX—IX of FIG. 8.
Figure 10:
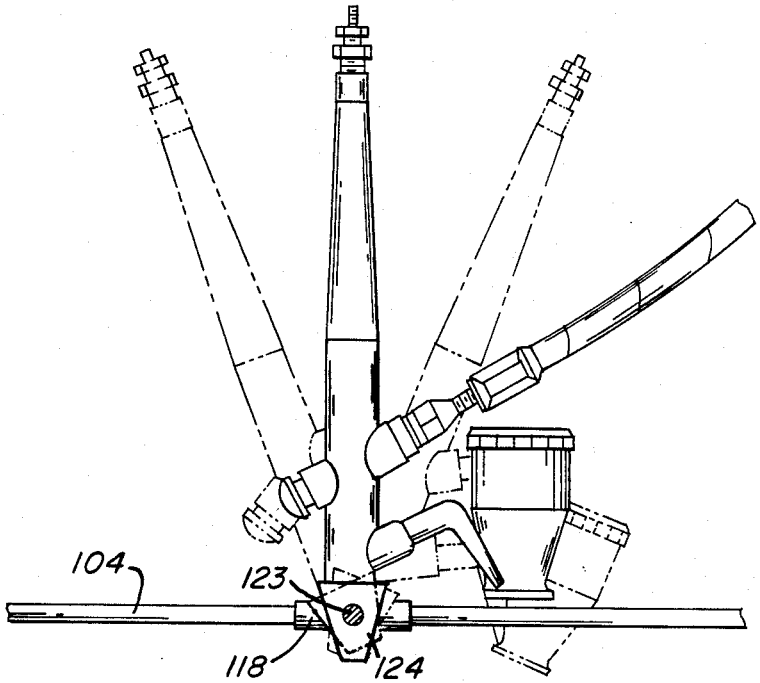
FIG. 10 is a fragmentary sectional view taken on line X—X of FIG. 8

In FIGS. 8, 9 and 10 there is shown another presently preferred embodiment of the invention. In FIG. 8, the airbrush support apparatus comprises a rigid hoop 100 which is supported by leg assemblies 102 with respect to a workpiece (not shown). A rigid crossbar assembly 104 comprises a pair of crossbars 106 and 108 extending in mutually parallel orientation and diametrically across hoop 100. The ends of crossbars 106 and 108 are captured by end members 110, and each end member 110 carries one or more rollers 112 which are engaged within a radially inwardly facing groove 114 formed in hoop 100. Crossbar assembly 104 thus is supported for free rotation with respect to hoop 100. Set screws 116 or other suitable locking means may be provided in end members 110 to engage hoop 100 and thereby lock crossbar assembly 104 in a fixed position with respect to hoop 100.

A slide assembly 118 is longitudinally slidable along crossbar assembly 104 and comprises a pair of tubular bearings 120 and 122 which encompass bars 108 and 106, respectively. An airbrush receiving member such as a cup 124 is disposed between bearing members 120 and 122 and is pivotally secured thereto by means of a pivot pin 123 for movement through a range of angular positions for the purpose of permitting variation of the angular orientation with respect to a workpiece of an airbrush received in cup 124 as shown in FIG. 10. Alternatively, the cup 124 may be mounted in a gimbal suspension (not shown) or other multi-axis pivot device to provide a greater range of angular motion for the airbrush.

A template 126 may be retained as by clips 128 adjacent the lower side of hoop 100. The template 126 preferably provides a guide surface 130 which is engageable by the lateral sides of cup 124 to permit use of the template in guiding the airbrush in a predetermined locus of orbital movement. Of course, to accomplish this, the lateral sides of cup 124 vertically overlap the surface 130, preferably throughout the range of available pivotal movement of cup 124 as above described.

It will be seen that with set screws 116 released, the airbrush is free to slide longitudinally along crossbar assembly 104, which is in turn free to rotate with respect to hoop 100. Accordingly, the airbrush may be utilized in free hand fashion for airbrush renderings throughout the area of a workpiece encompassed by hoop 100.

The standoff distance of the airbrush from the workpiece surface is adjustable by adjustment of leg assemblies 102. As with the above described embodiments, the standoff distance is predeterminable but not necessarily constant throughout the range of available airbrush movement over the surface. In the prsent instance, two sets of leg assemblies 102 are independently adjustable such that one side of hoop 100 may be positioned lower or higher than the opposite side whereby the predetermined standoff distance may vary from one side of the hoop to the other, and the standoff distance of the brush therefore may be varied in conjunction with movement of the airbrush within the confines of hoop 100 as described.

To adjust the standoff distance, leg assemblies 102 may be provided with telescoping sections 132 which are operable in the same manner as described above with reference to the FIG. 1–8 embodiments. Alternatively, or in addition, leg assemblies 102 may be affixed to hoop 100 by means of ratchet assemblies 134 or other suitable pivoting adjustment mechanisms to permit pivoting adjustment of leg assemblies 102 to vary the airbrush standoff distance. The ratchet as shown may be a plurality of ratchet teeth 136 on each leg which cooperate with a spring loaded pawl (not shown) or other suitable ratcheting or indexing device to permit discreet angular adjustments of leg assemblies 102. Another suitable alternative leg adjustment mechanism might be a bolt and wing nut assembly which passes through the individual legs and the adjacent mounting members 138 which are rigidly affixed to hoop 100 to clamp legs 102 in a selected, continuosly variable angular position with respect to hoop 100.

According to the description hereinabove, the instant invention provides for improved modes of airbrush use and resultant posibilities for novel airbrush effects not heretofore contemplated by the art. From this specification, it will be clear that the inventor has envisioned an apparatus in which various elements are utilized independently or in combination to provide a variety of use modes and a variety of alternate embodiments of the invention. The disclosed and other embodiments thus having been envisioned and anticipated by the inventor, it is intended that the invention be construed broadly and limited only by the scope of the claims appended hereto.

I claim:

1. An apparatus for supporting and guiding an airbrush or similar instrument in spaced relationship with respect to a workpiece surface comprising:

a circular hoop means which is adapted to be supported in stationary relationship with respect to such a workpiece surface;

a rigid crossbar means extending diametrically of said hoop means and being supported thereby for free rotary movement with repect to said hoop means;

said crossbar means including an instrument holder means which is carried thereby and selectively movable with respect thereto and is adapted to retain such an instrument in a selectively adjustable angular orientation with respect to such a workpiece surface;

at least one of said hoop means, said crossbar means and said instrument holder means including adjustable means for selectively varying the standoff distance of such an instrument from the workpiece surface; and said crossbar means being cooperable with said hoop means to support such an instrument in a manner to permit free movement of the instrument over such a surface at a predetermined standoff distance and simultaneous variation of the angular orientation of the instrument with respect to such a surface.

2. The apparatus as claimed in claim 1 wherein said instrument holder means includes a slide assembly which is slideably carried by said crossbar means for free movement longitudinally thereof.

3. The apparatus as claimed in claim 2 wherein said instrument holder means includes an adjustable retention means which receives the tip of such an instrument for support thereof in a range of selected angular orientations with respect to the workpiece surface.

4. The apparatus as claimed in claim 3 additionally including guide means for guiding such an instrument in orbital movement.

5. The apparatus as claimed in claim 4 wherein said guide means includes a template means which is carried by said hoop means adjacent said crossbar means, said template having a guide surface of a selected profile corresponding to a selected locus of orbital movement for such an instrument.

6. The apparatus as claimed in claim 5 wherein said retention means is engageable with said guide surface of said template means for guiding such an instrument along such a selected locus in orbital movement.

7. The apparatus as claimed in claim 2 additionally including a plurality of independently adjustable leg means affixed to said hoop means for supporting said hoop means at a predeterminable standoff distance with respect to such a workpiece surface.

8. The apparatus as claimed in claim 7 wherein said adjustable leg means includes adjustable length telescoping leg sections.

9. The apparatus as claimed in claim 7 wherein said adjustable leg means include adjustable pivot connections of said leg means to said hoop means.

10. The apparatus as claimed in claim 7 wherein said crossbar means is supported with respect to said hoop means by roller means which are carried adjacent the opposite longitudinal ends of said crossbar means and are supportingly engaged by said hoop means.

11. The apparatus as claimed in claim 10 wherein said hoop means includes a radially inwardly facing groove which receives said roller means.

* * * * *